US005228540A

United States Patent [19]

Glaser

[11] Patent Number: 5,228,540

[45] Date of Patent: Jul. 20, 1993

[54] ELEVATOR CAR BRAKE WITH SHOES ACTUATED BY SPRINGS

[75] Inventor: Walter Glaser, Saddle River, N.J.

[73] Assignee: Hollister-Whitney Elevator Corp., Quincy, Ill.

[21] Appl. No.: 919,209

[22] Filed: Jul. 24, 1992

[51] Int. Cl.[5] ..... B66B 5/16

[52] U.S. Cl. ..... 187/89; 188/188

[58] Field of Search ..... 187/89, 90, 91, 88, 187/80, 81, 73, 38, 45; 188/180, 188, 189

[56] References Cited

U.S. PATENT DOCUMENTS

| | | | |
|---|---|---|---|
| 973,518 | 10/1910 | Kulp | 187/89 |
| 1,959,528 | 5/1934 | Federici | 187/89 |
| 3,327,811 | 6/1967 | Mastroberte | 187/89 |

*Primary Examiner*—Robert P. Olszewski
*Assistant Examiner*—Kenneth Noland
*Attorney, Agent, or Firm*—Brooks Haidt Haffner & Delahunty

[57] ABSTRACT

An elevator car braking system in which a pair of brake shoes engage and grip the hoisting ropes, part of the hoisting apparatus or the car guide rails when compressed springs, which are normally held in a compressed state by an electrically operable locking assembly, are released. The springs are compressible by a fluid operable piston and cylinder assembly. The springs move a cam follower, linked to one of the shoes, along cam surfaces shaped and disposed to cause the cam follower to move one brake shoe toward the other brake shoe. The locking assembly is responsive to car speed and/or movement of the car from a floor with its doors open. Switches operable by the cam follower control the car electrical controls so that movement of the car is prevented when the springs are not compressed and when there is excessive shoe wear.

18 Claims, 6 Drawing Sheets 3
1
2
9
8
2
4
7
7
6
5

To Car
Control Circuits
Power Supply 58
59
54
55
60
Control Responsive
To Car Speed And/Or
Car Movement From
Floor With Doors Open
62
61
56
49
Valve
63
57b
Pump
50
57a
43
Solenoid Reservoir 48
Valve
38
36
49
35
53
Pump
50
51
52

ELEVATOR CAR BRAKE WITH SHOES ACTUATED BY SPRINGS

FIELD OF THE INVENTION

This invention relates to an emergency brake and particularly, to an emergency brake for an elevator car. Such emergency brake can be activated by an unsafe condition, such as overspeeding of the elevator car or an elevator car leaving a floor with its door open.

BACKGROUND OF THE INVENTION

Elevator cars and other vehicles and devices, such as hooks, buckets and material harnesses on cranes or launching apparatus, are movable in two opposite directions, frequently by means of a cable or wire rope.

Generally speaking, elevator cars movable by hoist ropes are suspended by wire ropes which go over a traction sheave and down to a counterweight. The counterweight serves to reduce the power required to move the elevator and also to create traction (prevent slippage) with respect to the traction sheave. The traction sheave is driven directly by a motor or indirectly by a motor through a geared machine. A normal brake is applied to the drive to stop or hold the elevator at a floor.

With elevator cars, specifically, the usual elevator codes require that an emergency brake be included, such brake arresting the descent of the elevator car when it is descending at a speed in excess of a predetermined speed. A known braking device for such purpose is the safety device which grips the car guide rails even in the event of breakage of the elevator hoisting rope.

With a high factor of safety for the wire ropes, one country has recognized that these ropes never break and is allowing other emergency brakes in lieu of the safety device which grips the guide rails. Also, since counterweights are generally heavier than the elevator, with a mechanical failure, such as that of the normal brake, there is danger of the elevator overspeeding in the ascending direction In addition, depending on the load in the elevator car and with a mechanical failure, the car could leave the floor in either direction with the doors open. One country already requires emergency devices to be activated in the event of the above, and several other countries are considering code changes to require ascending car overspeed protection, as well as protection against leaving the floor with the doors opened. Known braking devices include brakes applied to the hoisting drum (traction sheave), to the hoisting ropes, or to the car or counterweight guide rails.

It is considered to be important that the braking force be substantially constant even with wear of various elements of the braking system, such as wear of the brake shoe linings.

Braking apparatus which will stop an elevator when it overspeeds in either direction is known in the art and includes brake elements applied to the hoisting (suspension) ropes by air actuated means. While such apparatus will maintain the braking pressure constant with brake shoe lining wear, the apparatus includes several elements, such as hoses, tanks and an air cylinder or air compressor, which are subject to failure which can render the braking inoperative.

BRIEF SUMMARY OF THE INVENTION

In accordance with the preferred embodiment of the invention, springs press brake shoes into engagement with the ropes controlling the movement of an apparatus, such as an elevator car, although the invention is applicable to the control of other apparatus and to engagement with other elements such as a hoisting drum or the guide rails of an elevator car. Thus, in the preferred embodiment, the brake shoes, with linings, are pressed toward the hoisting ropes by springs which are connected to the brake shoes through a cam and lever arrangement, which are compressed by a fluid operable piston and cylinder device and which are released for application of the braking force to such ropes under control of an overspeed responsive governor or the conventional control of an elevator system which indicates that a car is moving from a floor with its door open. In this way, failure of the fluid operable piston and cylinder device does not permit travel of a car. Also, by reason of the cam and lever arrangement, the braking force of the springs is multiplied, requiring springs exerting a force less than the braking pressure, and the braking force is maintained substantially constant with wear of the brake shoe linings.

Thus, in the preferred embodiment, the hoisting ropes pass between the linings of a pair of brake shoes which, normally, are held apart by relatively small force springs so that the linings do not engage the ropes. A pair of links are pivotally connected to one of the shoes at one of the ends of the links, and the other ends of the links engage a cam follower which, when it is released by a latch controlled by an overspeed governor, rides on a pair of cam surfaces, under the force of a pair of springs, to cause the one shoe to move toward the other shoe and thereby, clamp the ropes between the shoe linings and arrest movement of the ropes. Normally, the pair of springs is compressed, and the springs are held in the compressed state by a latch so that the springs do not exert a force on the cam follower. The springs are initially compressed by a fluid actuated piston and cylinder device which, after compression of the springs has no further function except dampening and recompression of the springs after the follower has been released by the latch. Because of the shape of the cam, the force of the springs is multiplied and the braking force applied to the ropes remain substantially constant even with wear of the linings.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

Although the invention will be described in connection with braking apparatus for applying a braking force to the hoisting ropes of an elevator car, it will be apparent to those skilled in the art that the braking apparatus can have other applications, e.g. to the guide rails or the hoisting drum of an elevator car, other translatable equipment, etc.

Figure 1:
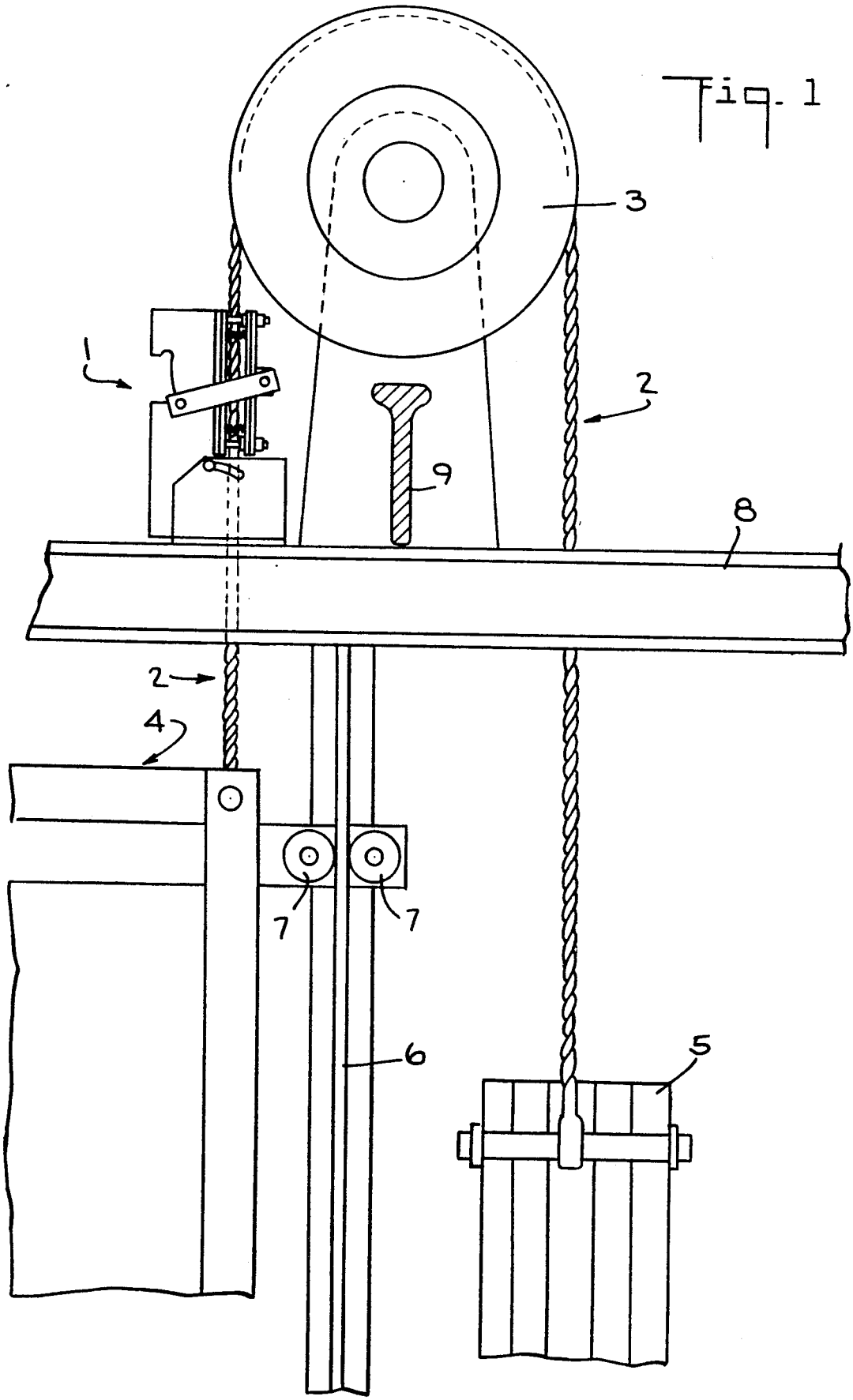
FIG. 1 is a schematic, side elevation view of the application of the invention to an elevator system.

FIG. 1 illustrates schematically, in side elevation, an elevator system comprising the braking apparatus 1 associated with hoisting ropes 2 which pass over a motor driven traction sheave 3. The ropes 2 suspend and hoist an elevator car 4 at one side of the sheave 3, and, at the opposite side of the sheave 3, are attached to a counterweight 5. The car 4 is guided at opposite sides by guide rails and rollers, only one combination of which, rail 6 and rollers 7, are shown. The sheave 3 and its supporting apparatus are supported by fixed beams 8 and 9, and the braking apparatus 1 is supported by the beam 8, although it may be otherwise located on a fixed support.

Except for the braking apparatus 1, the equipment described in the preceding paragraph is conventional. The braking apparatus is in a fixed position and engages the ropes 2 at the side of the sheave 3 at which the rope or ropes 2 extend to the car 4 or may engage the rope or ropes at the side of the sheave 3 which extend to the counterweight 5. Also, the shoes (hereinafter described) of the braking apparatus 1 of the invention may be applied to braking of the sheave 3 in the same manner as the conventional sheave braking apparatus (not shown) or may be carried by the car 4 and applied to the guide rail 6, or if two of the braking apparatuses 1 are carried by the car 4, to the guide rail 6 and the opposite, corresponding guide rail (not shown). In all cases, relative movement between the braking apparatus and another member is arrested when the braking apparatus is actuated.

The braking apparatus 1 is shown in greater detail in FIGS. 2–5 and comprises a metal member 10, comprising a pair of walls 13 and 14 secured to the beam 8 by a pair of metal angle members 11 and 12. Between the walls 13 and 14 of the member 10, there are a pair of compressed springs 15 and 16 which apply pressure to cam means comprising a cam follower 17 which is pivotably carried by a pair of metal links 18 and 19 and which, at its opposite ends, engages a pair of cam surfaces 20 and 21 formed in the walls 13 and 14. The opposite ends of the links 18 and 19 are pivotally connected to a movable metal brake shoe 22 which is slidable on pins 23 and which is urged away from a fixed metal brake shoe 24, secured to the walls 13 and 14 in any conventional manner, by springs 27. Each of the shoes 22 and 24 has a conventional brake lining 25 and 26 which can, for example, be a rigid, molded, asbestos free lining of the type sold by Raymark Industrial Division, 123 East Stiegel St., Mankum, Pa. 17545 under the type No. M-9723.

It will be apparent that when the shoe 22 is moved toward the shoe 24 by a sufficient amount, the linings 25 and 26 will engage the ropes 2 and that when sufficient pressure is applied to the ropes 2 by the linings 25 and 26, movement of the ropes 2 relative to the shoes 22 and 24 will be arrested. Such pressure can be of the order of 10,000 pounds, and with the apparatus of the invention such pressure can be developed with springs 15 and 16 which exert a force on the follower 17 of 1000 pounds each. For mechanical reasons, two springs 15 and 16 are preferred to one spring exerting a force on the follower 17.

As hereinafter described, the springs 15 and 16 are held compressed during normal operation of the elevator car. However, under abnormal conditions, such as overspeeding of the car, or departure of the car from a floor with its door open, the springs 15 and 16 are released and cause the follower 17 to move upwardly, as viewed in FIGS. 2–5. The cam surfaces 20 and 21 are shaped, as indicated in the drawings, so that the spacing of their surfaces from the shoe 22 in the release position increases in the upward direction. Accordingly, as the follower 17 moves upwardly, following the cam surfaces 20 and 21, the follower 17, by way of the links 18 and 19, pulls the shoe 22 toward the shoe 24 causing the linings 25 and 26 to grip the ropes 2.

The cam follower 17 has an outer portion 29 encircling an inner shaft 30 (see FIG. 3) which is rotatable with respect to the outer portion 29. The springs 15 and 16 are mounted on guides, only one of which, 31, is visible in the drawings, which are pivotally mounted at their lower ends. Each guide comprises a tube **31*a* held in a position which is fixed relative to its axis and a rod 31*b* which slidably telescopes within the tube 31*a* (see FIG. 3). The upper end of the rod 31*b* is secured to the follower portion 29. The upper ends of the springs 15 and 16 have caps 33 and 34 which are shaped to engage and hold against the follower portion 29 as it moves, but they also can be fastened to the follower portion 29** in any desired manner.

Intermediate the springs 15 and 16, there is spring compressing means comprising a hydraulic piston and cylinder assembly 35 which, preferably, is oil actuated, and which is connected to a fluid source, as described hereinafter, by a hose 36. The upper end of the piston rod 38 is fastened to the follower portion 29 by a block 39 which is secured to the portion 29, such as by welding, and to the rod 38 by a pin 40 (see FIG. 3). When fluid is introduced into the assembly 35 by way of the hose 36, the follower 17 is pulled downwardly by the rod 38, compressing the springs 15 and 16 and by way of the links 18 and 19 causing the shoe 22 to move away from the shoe 24, assisted by the springs 27, and away from the ropes 2. The parts of the braking apparatus 1 assume the positions shown in FIG. 3 in which the ropes 2 and the braking apparatus 1 are free to move relative to each other.

Figure 3:
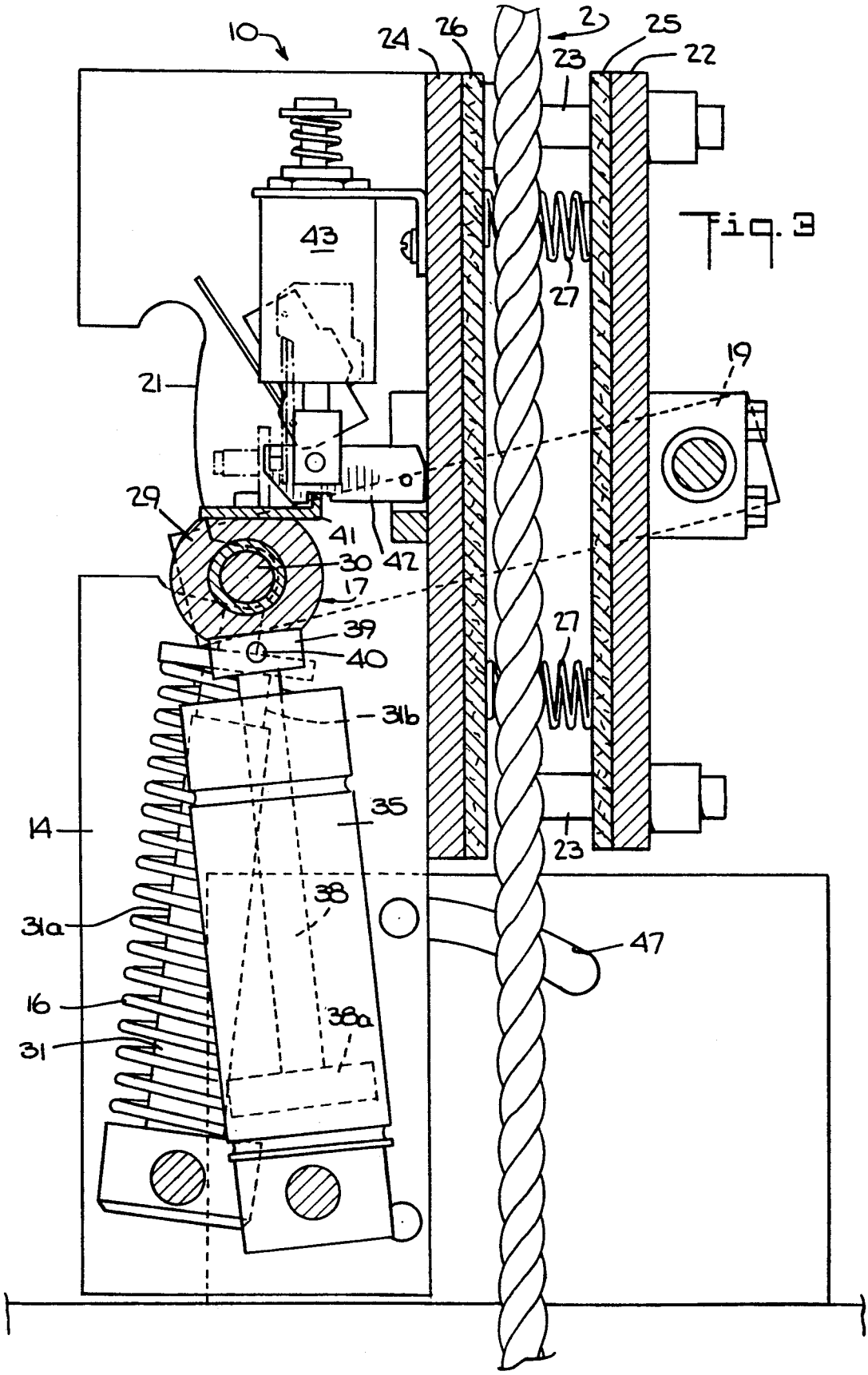
FIG. 3 is an enlarged, side elevation view, partly in cross-section, of a portion of the apparatus shown in FIG. 2 with the parts in the brake release positions thereof.
Figure 4:
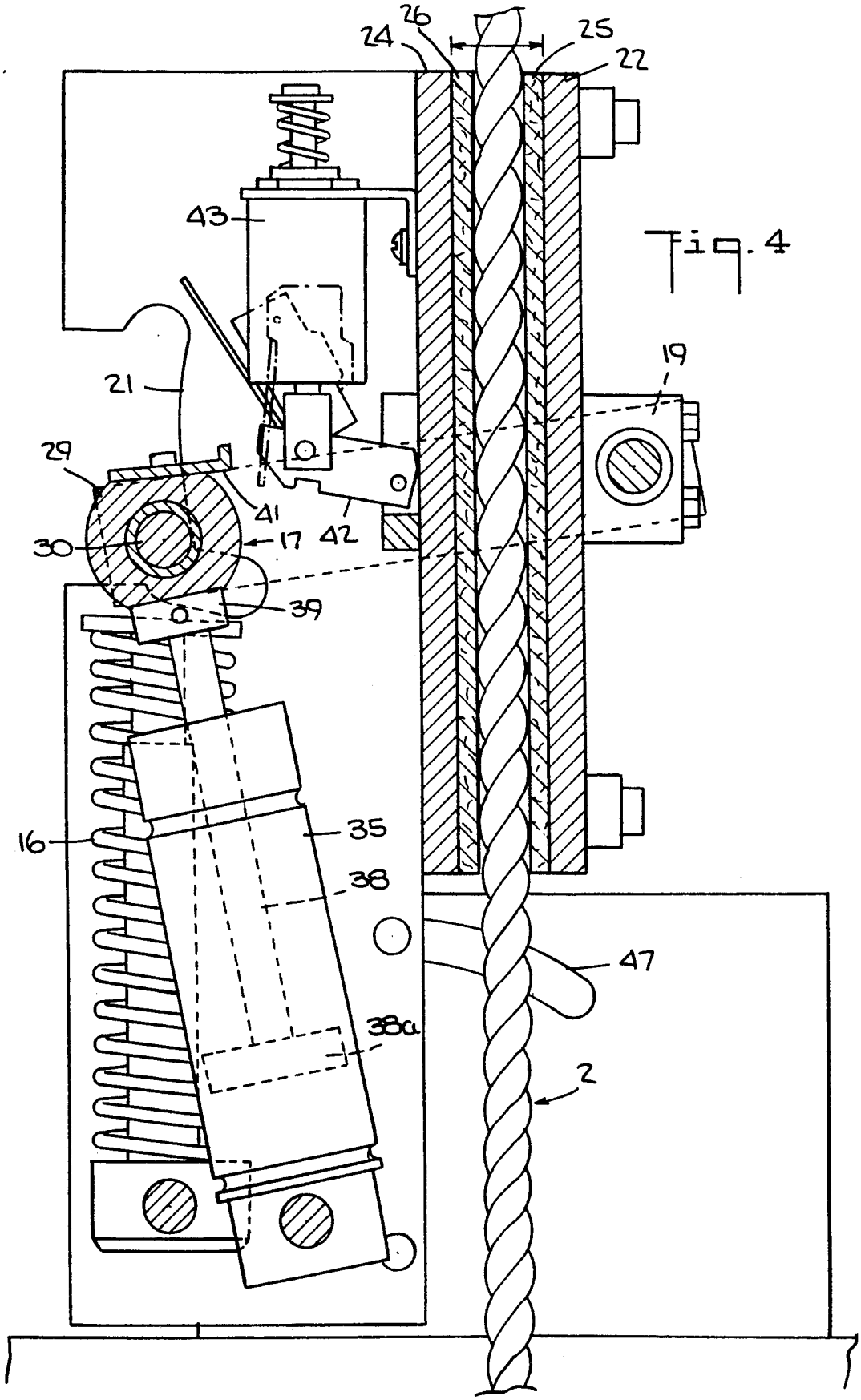
FIG. 4 is similar to FIG. 3 but illustrates the parts in the brake applied positions thereof and little or no wear of the brake shoe linings.

The follower portion 29 is held in the position in which the springs 15 and 16 are compressed by a locking assembly comprising a strike, or latch engaging member, 41 fastened to the follower portion 29, such as by bolts 32, and a latch, or tongue, 42. Due to the shape of the cam surfaces 20 and 21 (see FIGS. 3 and 4), the force applied to the locking assembly is small compared to the forces of the springs 15 and 16 when the springs 15 and 16 are fully compressed as shown in FIG. 3.

Figure 5:
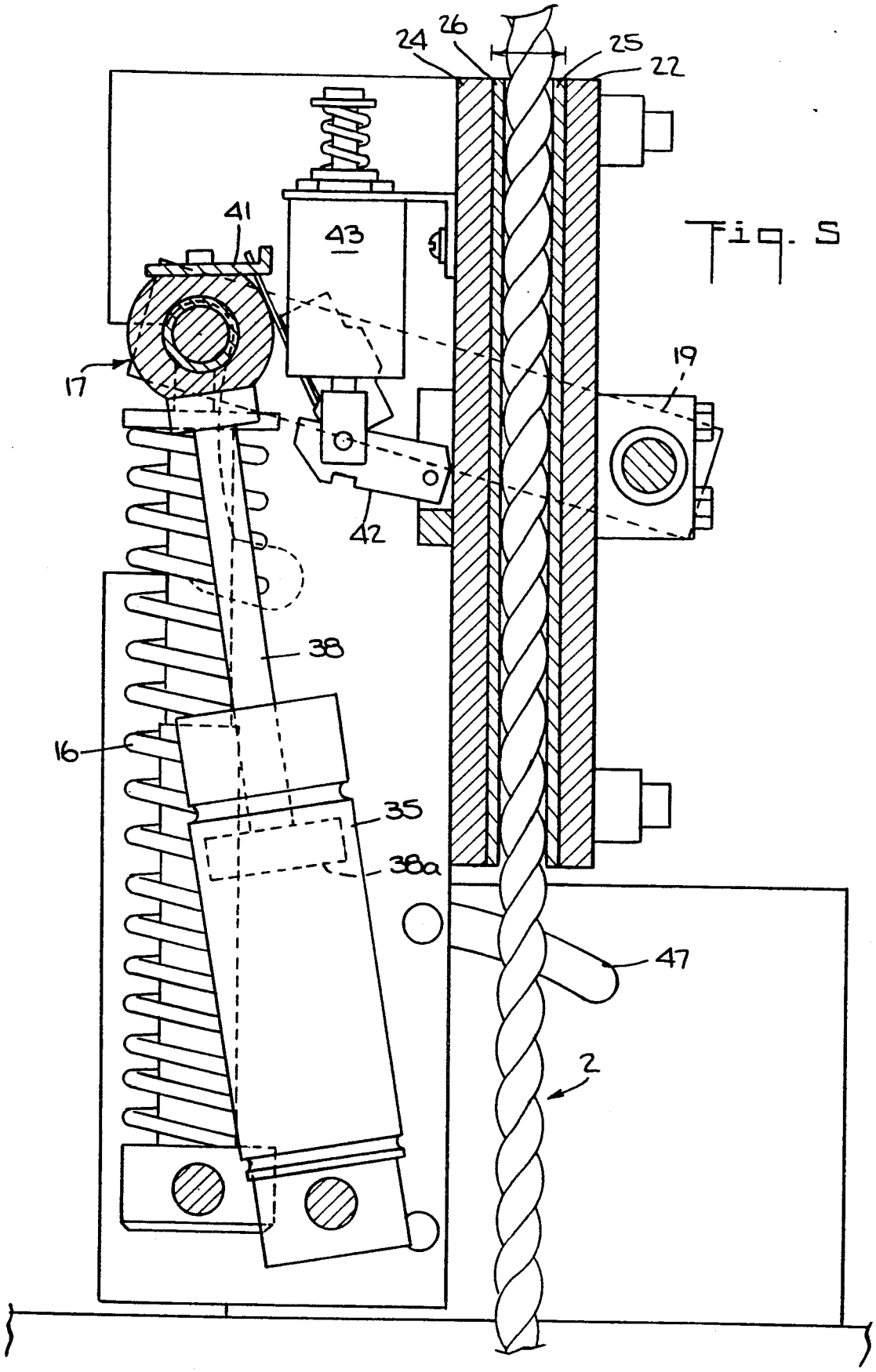
FIG. 5 is similar to FIG. 4 but illustrates the parts in the positions thereof with wear of the brake shoe linings.

The latch 42 is carried by the armature of an electrically energizable solenoid 43 mounted on the shoe 24 and is normally urged toward the strike 41 by energization of the solenoid 43. When the solenoid 43 is deenergized, the latch 42 is disengaged from the strike 41 which releases the follower 17 and permits the springs 15 and 16 to move the follower 17 upwardly into the position shown in FIG. 4. It will be observed by examining FIG. 4 that without significant wear of the linings 25 and 26, the follower 17 does not reach the top of the cam surfaces 20 and 21. However, as shown in FIG. 5, when the linings 25 and 26 wear, and become thinner, the follower 17 moves farther up the cam surfaces 20 and 21 to compensate for such wear.

When the follower 17 moves upwardly under the forces of the springs 15 and 16, the fluid in the assembly 35 is returned to the fluid source by way of the hose 36, and the upward movement of the follower 17 is dampened by reason of the fluid in the assembly 35 because of the expulsion of fluid from the assembly 35 due to upward movement of the piston rod 38, and hence, the piston 38*a*, attached thereto.

Figure 2:
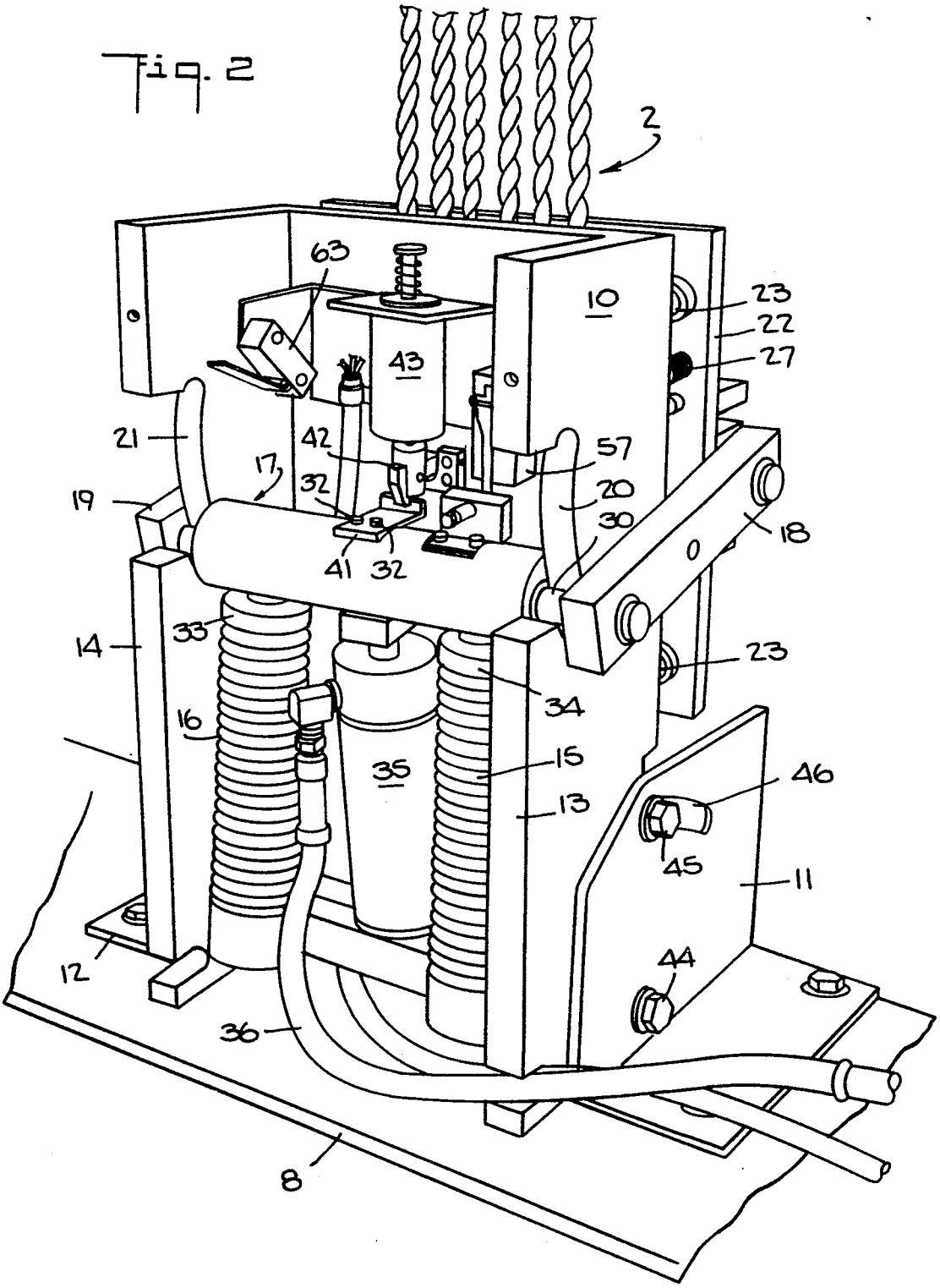
FIG. 2 is an enlarged, perspective view of a portion of the apparatus shown in FIG. 1.

The angle members 11 and 12 are secured to the respective walls 13 and 14 by bolts or cap screws, such as the bolts or cap screws 44 and 45. The bolt 45, and the corresponding bolt securing the angle member 12 to the wall 14, pass through arcuate slots 46 and 47 (FIGS. 2 and 3). Therefore, by loosening the bolts 44 and 45, and the corresponding bolts at the wall 14, the walls 13 and 14 and the equipment support thereby, can be tilted as desired to accommodate ropes 2 disposed differently from the positions shown in the drawings.

Figure 6:
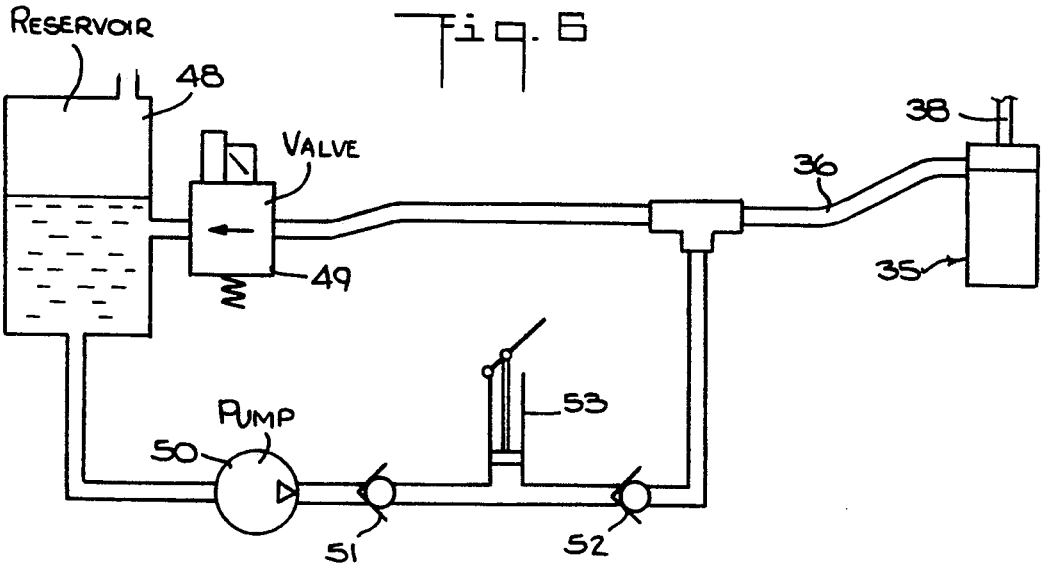
FIG. 6 is a schematic diagram of a fluid system for operating the fluid operable piston and cylinder device which compresses the brake actuating springs.

FIG. 6 illustrates schematically an hydraulic oil system for operating the piston and cylinder assembly 35 The system comprises an oil reservoir 48 connected to the hose 37 through a normally open, electrically operable dump valve 49, with manual override. The hose 36 is connected to a T fitting and to the assembly 35. An electrically operable, hydraulic pump 50 is connected to the reservoir 48 and to the hose 36 through a pair of check valves 51 and 52. If it is desired to compress the springs 15 and 16 manually, a hand pump 53 is provided. During compression of the springs 15 and 16, the dump valve 49 is closed and the pump 50 is operated until the springs 15 and 16 are fully compressed and the latch 42 engages the strike 41. Thereafter, the pump 50 can be deenergized and the valve 49 opened so that when the springs 15 and 16 expand with deenergization of the solenoid 43, oil flows from the assembly 35 to the reservoir 48 through the dump valve 49.

Figure 7:
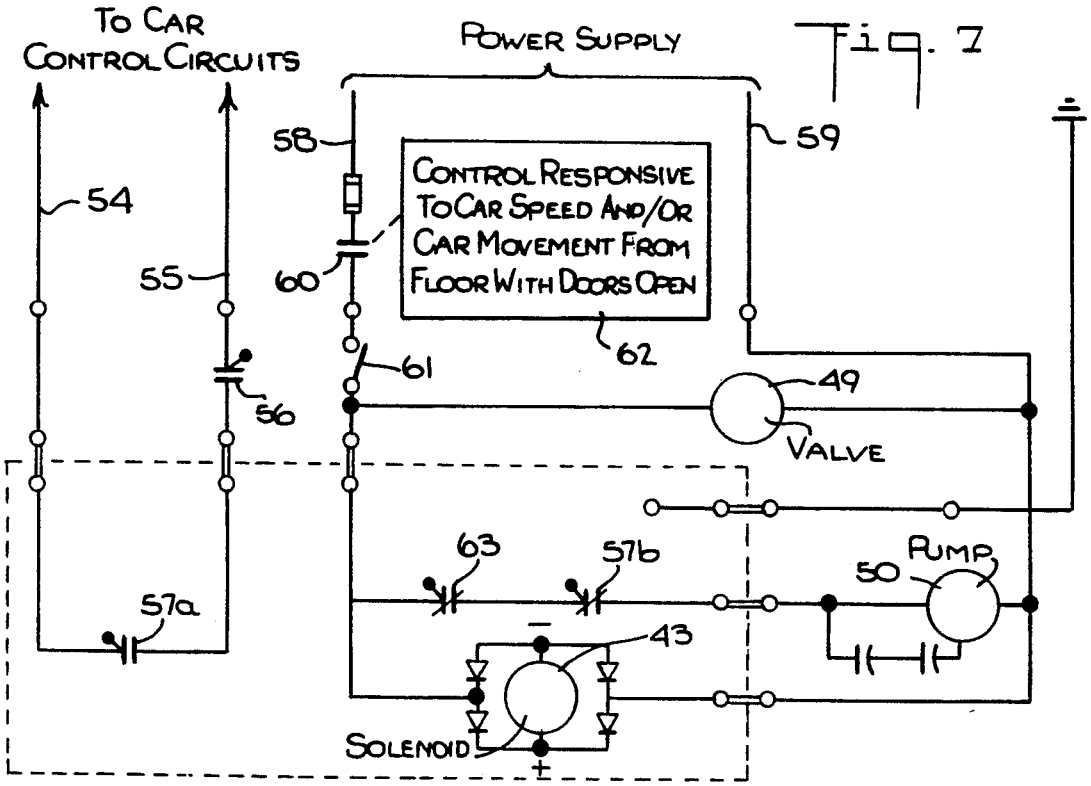
FIG. 7 is a schematic electrical diagram for use with the apparatus of the invention.

FIG. 7 is a schematic diagram illustrating the electrical circuits added to conventional and known elevator car circuits for controlling the braking apparatus of the invention and for controlling the car operation. The devices within the dashed lines are on the braking apparatus 1.

The leads 54 and 55 extend to the conventional car circuits which must be completed to permit the elevator car to run. The leads 54 and 55 are in series with a normally closed, manually operable switch 56 which, when opened, prevents car movement; and a two pole switch 57 (see FIG. 2) which has one pole 57*a* which is closed when the springs 15 and 16 are compressed. Therefore, the car cannot move if the springs 15 and 16 are not compressed.

Leads 58 and 59 extend to the elevator system power supply, and lead 58 is in series with a normally closed control switch or contact 60 and a manually operable, normally closed test switch 61. The test switch 61, when opened, releases the springs 15 and 16 and applies the linings 25 and 26 to the ropes 2. The control switch or contact 60 is openable by either or both of the conventional apparatus in an elevator car system, illustrated by the rectangle 62 which are responsive to car speed, and hence, the speed of the ropes 2, and to movement of an elevator car from a floor with its doors open. The speed responsive apparatus can, for example, be an electrical generator connected to the sheave 3 and providing an output voltage dependent on the speed of rotation of the sheave 3. When the output voltage exceeds a predetermined value, it operates a relay which opens the control switch 60. Conventional elevator systems also have circuits which indicate when a car moves from a floor with its door or doors open, and such circuits can, in an obvious manner, open the control switch 60.

When the switches 60 and 61 are closed, the solenoid 43 is energized through an obvious circuit so that after the springs 15 and 16 are compressed, the springs are held in their compressed state by the latch 42 and the strike 41 and the dump valve 49 is closed. If either of the switches 60 or 61 is opened, the dump valve 49 is opened and the solenoid 43 is deenergized, releasing the springs 15 and 16 causing the linings 25 and 26 to engage the ropes 2 and to arrest movement of the latter.

The motor of the pump 50 is connected in series between the power leads 58 and 59 through a pair of normally closed switches 63 and 57*b* (see FIGS. 2 and 7), the switch 57*b* being the second pole of the switch 57. Switch 63 is opened when the wear of the linings 25 and 26 is excessive, e.g. the follower 17 reaches the limit of its upward movement. The switch 57*b* opens when the springs 15 and 16 are compressed and locked. If the switch 63 is open, the pump 50 cannot operate to compress the springs 15 and 16, and if the switch 57*b* is open, which occurs after the springs 15 and 16 are compressed, the pump 50 stops.

From the foregoing, it is apparent that under normal operating conditions, the springs 15 and 16 are compressed and the shoes 22 and 24 have their linings 25 and 26 spaced apart permitting the ropes 2 to pass freely therebetween. However, if the control switch 60 is opened, by reason of either overspeeding of the elevator car 4, in either the up or down direction, or movement of the car 4 from a floor with its doors open, the springs 15 and 16 will be released by the solenoid 43 and the linings 25 and 26 will grip the ropes 2 and arrest movement of the car 4.

Due to the cam surfaces 20 and 21, the forces of the springs 15 and 16 are multiplied and there is compensation for wear of the linings 25 and 26 until a predetermined amount of wear is reached.

Also, it is apparent that since the hydraulic system is used only to compress the springs 15 and 16, the operation of the brakes in abnormal conditions is not prevented by failure of such system after the springs 15 and 16 have been compressed. In other words, application of the brakes is not dependent on the hydraulic system once the springs 15 and 16 have been compressed and locked.

It will be apparent to those skilled in the art that various modifications of the braking apparatus can be made without departing from the principles of the invention. For example, the cam surfaces 20 and 21 can be inverted and can be moved by the springs 15 and 16 while preventing vertical movement of the follower 17. Also, the follower 17 and the cam surfaces 20 and 21 can be disposed at the opposite side of the shoe 22 so that the follower 17 pushes, rather than pulls, the shoe 22 toward the shoe 24. Furthermore, while hydraulic means for compressing the springs 15 and 16 is preferred, other compressing means can be used.

I claim:

1. Braking apparatus comprising:

a pair of brake shoes having facing surface faces one of said shoes being mounted for movement of its face toward the face of the other of said shoes;

cam means connected to said one of said shoes for moving the face of said one of said shoes toward the face of the other of said shoes;

compressible spring means connected to said cam means for actuating said cam means and thereby causing said face of said one of said shoes to move toward the face of the other of said shoes;

compressing means connected to said spring means for compressing said spring means; and releasable locking means connected to said spring means for holding said spring means in its compressed state after said spring means has been compressed by said compressing means;

whereby upon release of said locking means, said spring means actuates said cam means and moves the face of said one of said shoes toward the face of the other of said shoes.

2. Braking apparatus as set forth in claim 1 wherein said cam means comprises a cam surface means providing a cam surface and comprises a cam follower engaging said cam surface, wherein one of said cam surface means and said cam follower is connected to said spring means for movement thereby and is connected to said one of said shoes and wherein said cam surface is shaped and disposed to cause said one of said cam surface means and said cam follower to move said one shoe toward said other shoe with movement of said one of said cam surface means and said cam follower by said spring means.

3. Braking apparatus as set forth in claim 2 wherein said cam surface means is mounted in a fixed position and said cam follower is connected to said one of said shoes and to said spring means.

4. Braking apparatus as set forth in claim 3 wherein said other of said shoes is intermediate said one of said shoes and said cam means and said cam follower is pivotally connected to said one of said shoes by a link pivotally connected to said cam follower and to said one of said shoes.

5. Braking apparatus as set forth in claim 4 wherein said compressing means comprises a fluid actuable piston and cylinder assembly.

6. Braking apparatus as set forth in claim 5 wherein releasable locking means comprises a strike mounted on said cam follower and an electrically operable solenoid carrying a latch engaging said strike, said solenoid being mounted in a fixed position.

7. Braking apparatus comprising:

a first brake shoe mounted in a fixed position and having a braking surface;

a second brake shoe at one side of said first brake shoe and having a braking surface facing, but spaced from, said braking surface of said first shoe, said second brake shoe being movable toward and away from said first shoe;

cam surface means mounted in a fixed position at the side of said first shoe opposite from said one side, said cam surface means providing a pair of spaced cam surfaces which increase in spacing from said second shoe and which face away from said second shoe;

a cam follower engaging said cam surfaces and movable in the direction from a lesser spacing of said cam surfaces from said second shoe to a larger spacing of said cam surfaces from said second shoe;

a pair of links pivotally connected to said cam follower and to said second shoe for moving said second shoe toward said first shoe in response to movement of said cam follower;

a pair of compressible springs intermediate said cam surfaces and pivotally connected to said cam follower and said second shoe for urging said cam follower in the direction in which it moves said second shoe toward said first shoe;

a hydraulic piston and cylinder assembly intermediate said springs and connected to said cam follower for compressing said springs; and releasable locking means connected to said cam follower for locking said springs in the state thereof to which they are compressed by said hydraulic piston and cylinder assembly, said releasable locking means, upon release thereof, permitting said springs to move said cam follower and move said second shoe toward said first shoe.

8. In an elevator system comprising an elevator car, car guide means, car hoisting apparatus including car hoisting ropes and electrical means responsive to car movement, the improvement comprising braking apparatus comprising:

a pair of brake shoes having facing surface faces one of said shoes being mounted for movement of its face toward the face of the other of said shoes, said brake shoes being engageable with one of said car guide means and said hoisting apparatus for arresting movement of said car;

cam means connected to said one of said shoes for moving the face of said one of said shoes toward the face of the other of said shoes;

compressible spring means connected to said cam means for actuating said cam means and thereby causing said face of said one of said shoes to move toward the face of the other of said shoes;

compressing means connected to said spring means for compressing said spring means; and releasable locking means responsive to said electrical means and said spring means for holding said spring means in its compressed state after said spring means has been compressed by said compressing means;

whereby upon abnormal movement of said car, said locking means is released and said spring means actuates said cam means and moves the face of said one of said shoes toward the face of the other of said shoes and causes said shoes to engage and grip said one of said car guide means and said hoisting apparatus.

9. Braking apparatus as set forth in claim 8 wherein said cam means comprises a cam surface means providing a cam surface and comprises a cam follower engaging said cam surface, wherein one of said cam surface means and said cam follower is connected to said spring means for movement thereby and is connected to said one of said shoes and wherein said cam surface is shaped and disposed to cause said one of said cam surface means and said cam follower to move said one shoe toward said other shoe with movement of said one of said cam means and said cam follower by said spring means.

10. Braking apparatus as set forth in claim 9 wherein said cam surface means is mounted in a fixed position and said cam follower is connected to said one of said shoes and to said spring means.

11. Braking apparatus as set forth in claim 10 wherein said other of said shoes is intermediate said one of said shoes and said cam means and said cam follower is pivotally connected to said one of said shoes by a link pivotally connected to said cam follower and to said one of said shoes.

12. Braking apparatus as set forth in claim 11 wherein said compressing means comprises a fluid actuable piston and cylinder assembly.

13. Braking apparatus as set forth in claim 12 wherein releasable locking means comprises a strike mounted on said cam follower and an electrically operable solenoid carrying a latch engaging said strike, said solenoid being mounted in a fixed position.

14. Braking apparatus as set forth in claim 8 wherein:

said pair of brake shoes comprises a first brake shoe mounted in a fixed position at one side of said hoisting ropes, and a second brake shoe at the other side of said hoisting ropes and spaced from said first shoe, said second brake shoe being movable toward and away from said first shoe;

said cam means comprises cam surfaces means mounted in a fixed position at the side of said first shoe opposite from said second shoe, said cam surface means providing a pair of spaced cam surfaces which increase in spacing from said second shoe and which face away from said second shoe, a cam follower engaging said cam surfaces and movable in the direction from a lesser spacing of said cam surfaces from said second shoe to a larger spacing of said cam surfaces from said second shoe and a pair of links pivotally connected to said cam follower and to said second shoe for moving said second shoe toward said first shoe in response to movement of said cam follower;

said compressible spring means comprises a pair of compressible springs intermediate said cam surfaces and pivotally connected to said cam follower and said second shoe for urging said cam follower in the direction in which it moves said second shoe toward said first shoe;

said compressing means comprises a hydraulic piston and cylinder assembly intermediate said springs and connected to said cam follower for compressing said springs; and said releasable locking means is connected to said cam follower.

15. Braking apparatus as set forth in claim 14 further comprising switch means operable by said cam means when said springs are compressed.

16. Braking apparatus as set forth in claim 14 further comprising switch means operable by said cam means when, after said locking means is released, movement of said cam follower exceeds a predetermined amount.

17. An elevator system as set forth in claim 8 wherein said electrical means is responsive to the speed of the car movement and wherein said releasable locking means comprises a solenoid connected to said electrical means and a locking mechanism operable by said solenoid.

18. An elevator system as set forth in claim 8 wherein said electrical means is responsive to movement of the car from a floor with its doors open and wherein said releasable locking means comprises a solenoid connected to said electrical means and a locking mechanism operable by said solenoid.

* * * * *